US005531663A

United States Patent [19]

Gloyd et al.

[11] Patent Number: 5,531,663

[45] Date of Patent: Jul. 2, 1996

[54] INCUBATOR MATTRESS TILT MECHANISM

[75] Inventors: David A. Gloyd; Colin G. Hodge; Thomas C. Jones, all of Columbia; Vladimir Kremenchugsky, Reisterstown; Robert M. Siminauer, Ellicott, all of Md.

[73] Assignee: Ohmeda Inc., Liberty Corner, N.J.

[21] Appl. No.: 335,612

[22] Filed: Nov. 8, 1994

[51] Int. Cl.[6] ..... A61G 11/00

[52] U.S. Cl. ..... 600/22; 5/11

[58] Field of Search ..... 600/21–22; 5/11, 5/600, 603, 607, 608–610, 612–613

[56] References Cited

U.S. PATENT DOCUMENTS

| | | | |
|---|---|---|---|
| 4,734,945 | 4/1988 | Wright | 5/11 |
| 4,885,918 | 12/1989 | Vaccaro | 600/22 |
| 4,934,007 | 6/1990 | Sweet | 5/11 |
| 4,935,974 | 6/1990 | Stebbins et al. | 5/607 |
| 5,303,437 | 4/1994 | Hung | 5/607 |

FOREIGN PATENT DOCUMENTS

| | | | |
|---|---|---|---|
| 5103817 | 4/1993 | Japan | 600/22 |

*Primary Examiner*—Angela D. Sykes
*Assistant Examiner*—John P. Lacyk
*Attorney, Agent, or Firm*—Roger M. Rathbun; Larry R. Cassett

[57] ABSTRACT

An infant incubator tilt mechanism is disclosed that allows infinite adjustment of the tilt angle of the infant mattress within certain limits. The mechanism includes a bent rod positioned within the infant incubator itself and underlying the infant bed and which has an offset portion that engages a bed lifter. As the bent rod is rotated about an axis, the bent rod moves the bed lifter to raise and/or lower the infant bed. One end of the bent rod extends outwardly to the exterior of the infant compartment and is rotatable by an exterior mechanism having a lead screw that is rotated by the operator to cause lateral movement of a link mechanism along an axis at about ninety degrees to the axis of rotation of the bent rod. The lateral movement of the link is again translated into rotational movement and connects to the bent rod to translate that rotational movement to the bent rod. The entire tilt mechanism is readily removable so as to be easily cleaned.

17 Claims, 4 Drawing Sheets

INCUBATOR MATTRESS TILT MECHANISM

BACKGROUND OF THE INVENTION

This invention relates to infant incubators, and more particularly, to a means of setting and adjusting the tilt angle of an infant bed located within an infant incubator.

Infant incubators have a variety of ways of adjusting the angle of tilt of infant beds within the apparatus. It is preferable that the tilting mechanism be operable from external of the infant incubator so that the attending personnel do not have to open any doors or portholes to carry out the process of adjusting the tilt angle.

Further, it is advantageous that the tilt angle be moveable continuously or infinitely variable over a wide latitude of positions, both to raise and lower the infant head or feet and not be constrained to two or three preset conditions.

As a further feature, the tilt mechanism should be self sustaining, that is, once the level has been selected, it is preferable that the user merely release the control and have the selected position automatically stabilize at that position.

Too, the change in tilt angle must be relatively smooth and easy to operate without any abrupt movements so that the infant is not disturbed and is not startled in changing the tilt angle.

A current tilt mechanism is exemplified in U.S. Pat. No. 4,734,945 where a pair of selector handles rotate a pair of bent rods that raise and lower the infant position. As indicated, however, the position to be selected is limited to only a few selected positions and the operator cannot place the infant at any position intermediate the set positions made available by the manufacturer.

Another type of infant tilt mechanism is described in U.S. Pat. No. 4,885,918 wherein a scissors type of arrangement is utilized to change the tilt angle of the infant. While the scissors type does achieve a variety of positions that the operator can select for the infant, it does not allow for large, easy to actuate, handles for the user since the rotation of the actuators for the scissors extend directly out the front of the incubator. Thus, the knobs grasped by the user must be quite small so as to not impede the opening of the front door and the tilting is not convenient for the user.

A further difficulty with the scissors mechanism of the aforementioned U.S. Patent reside in the mechanism having relatively fine threads located within the infant compartment to operate the scissors. Not only to the fine threads require considerable rotations of the handle (18–20) to move the infant bed from one extreme position to the other, but the mechanism and the fine threads are subject to frequent contamination and are extremely difficult to clean. Thus the mechanism must be cleaned frequently and that cleaning is burdensome and inconvenient to the medical personnel.

SUMMARY OF THE INVENTION

There is herein described an infant incubator tilt mechanism that overcomes the problems in the prior art and which includes a mechanism that is infinitely variable between its fully raised and fully lowered positions and, when the operator has selected the desired tilt angle, the mechanism automatically retains the infant at that angle without the need to release any detents or other means to hold the desired position.

In the present tilt mechanism, a plurality of bent rods having a axis of rotation underlie the infant bed and which are secured to the incubator and are rotatable about that axis.

By rotating the bent rods, one end or the other of the infant bed may be reclined or elevated as desired by the operator. A bed lifter is also used and in turn is moved by the rotational movement of the bent rods.

Rotation of the bent rods about their axis of rotation is accomplished by a lever arm that is affixed to an end of the bent rod external of the incubator. That lever arm is joined by a linkage to a lead screw that is rotatable affixed to the infant incubator and which, when rotated by the user operating a large hand knob, causes lateral movement of the linkage. That lateral movement is translated into rotational movement of the bent rod through the lever arm and thus, by rotating the lead screw, the infant bed can readily be elevated or reclined.

The lead screw includes a large hand knob located alongside of the incubator and free from hindering the operation of the front door or in any way impeding the access to the infant. In rotating the hand knob, the rotational movement is, by means of a linkage, translated into rotational movement of the bent rod having an axis of rotation 90 degrees displaced from the axis of rotation of the hand knob.

By selecting the pitch of the lead screw, the number of turns is easily determined to move the infant bed between its extreme positions and can readily be a lesser number than the turns needed to operate the scissors mechanism cited earlier and thus more convenient to the user. In addition, the lead screw and substantially all of the components that operate the tilt system are located outside the infant compartment and thus are not subject to contamination. The entire mechanism is readily disassembled, however, for cleaning in a convenient and easy manner.

Preferable a tilt mechanism constructed in accordance with the present invention, is located at both ends of the incubator and therefore, the same mechanism, albeit mirror images, can be used to raise and/or lower either side of the infant bed.

BRIEF DESCRIPTION OF THE DRAWINGS

The invention is diagrammatically illustrated by way of example in the drawings appended hereto in which.

DESCRIPTION OF THE PREFERRED EMBODIMENT

Figure 1:
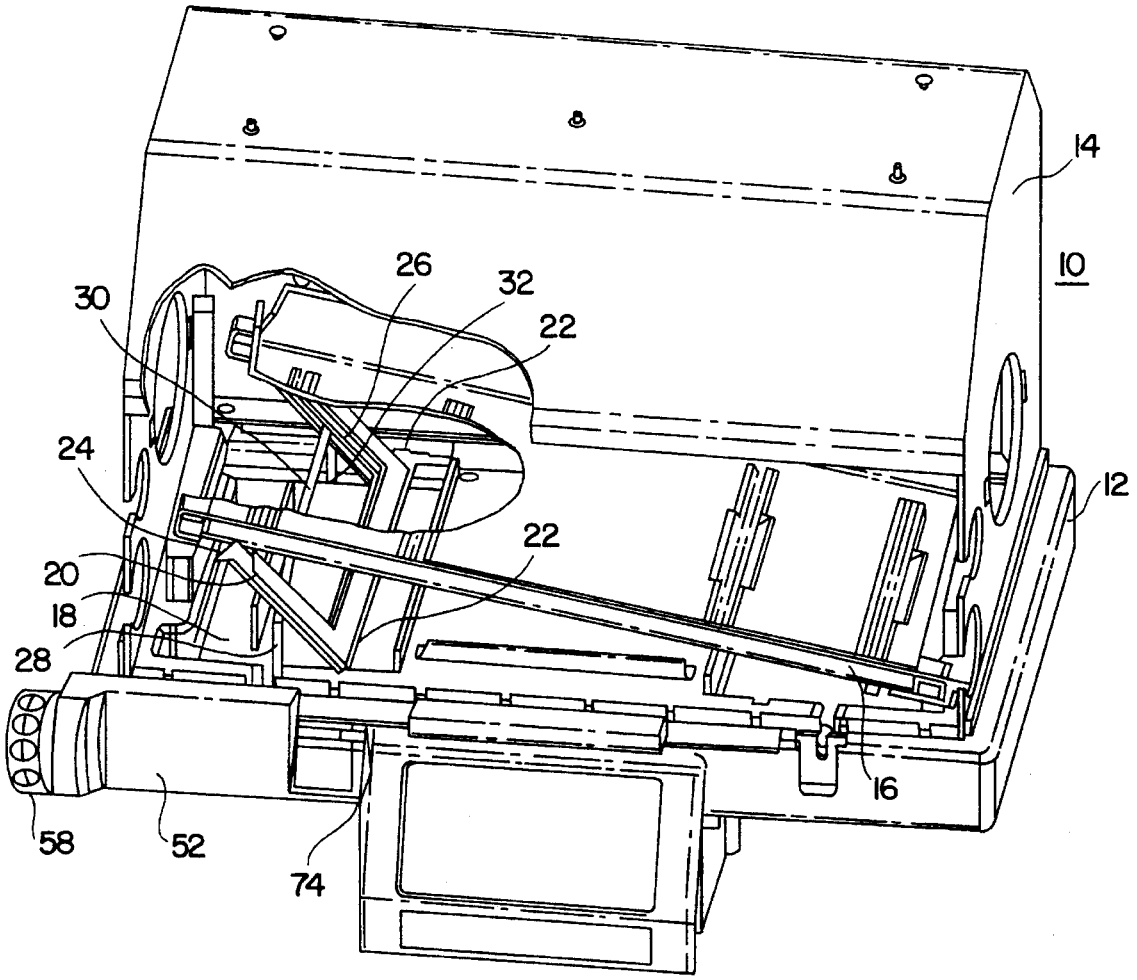
FIG. 1 is an isometric view of an incubator having a tilt mechanism constructed in accordance with the present invention.

In FIG. 1, there is shown an isometric view of an incubator 10 having incorporated therein, the tilt mechanism of the present invention. Parts of the infant incubator 10 have been omitted, however, the incubator itself is more specifically shown and described in U.S. Pat. No. 4,936,824 of Koch et al and the description in that patent is incorporated herein.

Basically, the incubator 10 shown in FIG. 1 includes a base 12 made of a structural plastic material and which would contain the equipment and controls necessary for a functioning incubator. A hood 14 sits atop the base 12 of incubator 10 and is generally comprised of a transparent material so that attending personnel can easily view the infant contained within the incubator 10. As shown in the aforementioned U.S. Pat. No. 4,936,824, the hood 14 also generally includes a front door, hand holes and the like for access to the infant.

Within incubator 10, there is positioned an infant bed 16 which is positioned beneath the transparent hood 14 and rests upon the base 12. The infant bed 16 is used to support the infant and would include a mattress to underlie that infant. As noted, the infant bed 16 is shown, partially cut-away, in FIG. 1 so that the functioning parts of the tilt mechanism can be more readily viewed.

As stated, it is important in the operation of the incubator 10 that the infant bed 16 be tiltable to various angles desired by the attending personnel. In certain applications, it is sometimes desirable to raise the level of the head of the infant and other times the feet of the infant is desired to be raised. As described in the present application, however, only one tilt mechanism will be presented, it being obvious that there will normally be a tilt mechanism at both ends of the infant bed 16, one being the mirror image of the other and therefore the description of but one of the tilt mechanisms is sufficient.

A recessed area 18 is formed in the base 12 and as will become apparent, the recessed area 18 receives various of the components of the tilt mechanism so that the infant bed 16 can be brought to a position level with the upper surface of the base 12 and the components are contained beneath the infant bed 16 within the recessed area 18.

A bed lifter 20 is rotatably affixed to the base 12 within the recessed area 18 and is rotatable about a pair of pivot points 22 formed therein. The specific details of the pivot points 22 will be later explained in connection with the details of the assembly and disassembly of the tilt mechanism for incubator 10. Bed lifter 20 has its other free end 24 positioned so as to support the infant bed 16 when it is raised or lowered with respect to base 12 and can be seen as engaging the infant bed 16.

Accordingly, as the bed lifter 20 is rotated about the pivot points 22, the free end 24 causes the infant bed 16 to be raised or lowered depending on the direction of the rotation of bed lifter 20. Bed lifter 20 also includes a pair of elongated slots 26, (only one of which is shown in FIG. 1) the purpose of which will become apparent.

A bent rod 28 is located beneath the infant bed 16 and includes an offset portion 30 that extends upwardly, at times, toward the infant bed 16. Bent rod 28 is also rotatably mounted to the base 12 and is rotatable about pivot points 32 (only one of which is shown in FIG. 1) that together form an axis of rotation for the bent rod 28. The bent rod 28 passes through each of the elongated slots 26 of bed lifter 20 such that the bed lifter 20 is raised or lowered as the bent rod 28 is raised or lowered.

Figure 2:
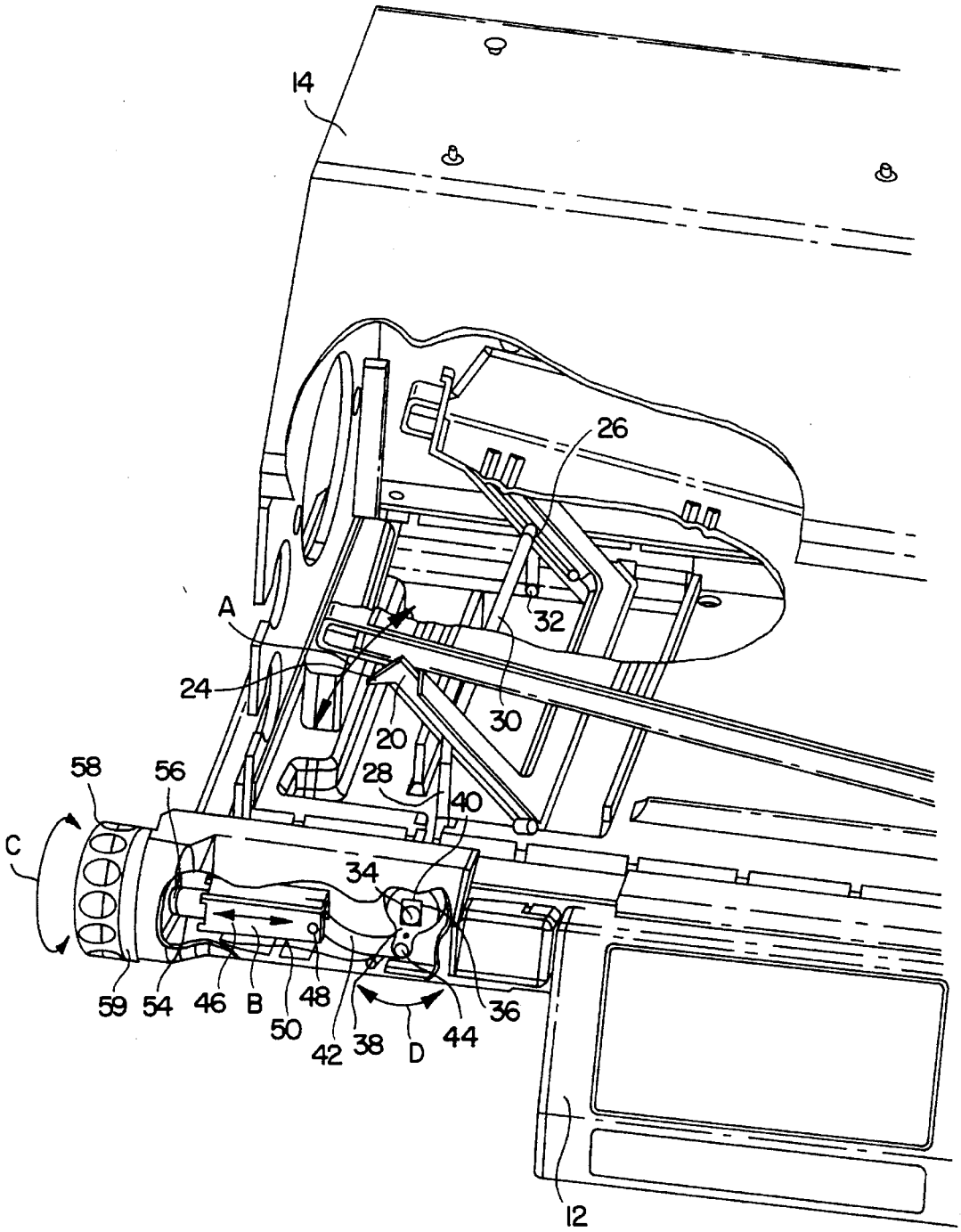
FIG. 2 is an isometric view, partially cutaway, showing further details of the tilt mechanism of the FIG. 1 embodiment.

Taking now FIG. 2, in conjunction with FIG. 1, there is shown an isometric view, partially broken away, showing further details of the tilt mechanism constructed in accordance with the present invention. In FIG. 2, it can be seen that the rotational movement of bent rod 28 also causes the movement of the bed lifter 20 in the directions of double arrow A.

One end of the bent rod 28 extends external of the incubator 10 and is coupled to a interface or key 34. The means of coupling the external end of bent rod 28 to the key 34 will be further explained later with reference to the means of disassembling and assembling the tilt mechanism.

Suffice it is to say that the external end of the bent rod 28 is, during operation, affixed to the key 34 and rotational motion of the bent rod 28 is transmitted directly to the key 34 and vice versa. The outer end of the key 34 is a square end 36, however any variety of keying arrangement may be used to connect the key 34 to a lever arm 38. A similar shaped hole 40 in the lever arm 38 causes the lever arm 38 and key 34 to rotate together.

A link 42 is, in turn, connected to the lever arm 38 at a junction point 44 that is offset a predetermined distance from the axis of rotation of the bent rod 28, that is, since the center of rotation of the key 34 is coaxial with the axis of rotation of the bent rod 28, the junction point 44 is thereby displaced that predetermined distance from the axis of rotation of key 34 as well as of lever arm 38.

A lead screw slide 46 is affixed at a junction point 48 to the other end of the link 42. Lead screw slide 46 has internal threads of known pitch and dimensions and slides along a lead screw slide bearing 50 formed within the cover 52. The lead screw slide bearing 50 allows the lead screw slide 46 to move laterally with respect to the incubator 10 but constrains the lead screw slide 46 from rotational movement. Lateral movement of lead screw slide 46 and, of course, link 42 is shown by the double arrow B.

Threadedly engaged to the lead screw slide 46 is a lead screw 54 having, obviously, external threads that are compatible to and threadedly engaged with the internal threads within the lead screw slide 46. The lead screw 54 is held within a lead screw bearing 56 and is thus allowed to rotate but lateral movement is constrained. A hand knob 58 of a relatively large size to make gripping by the user convenient, is located at the free end of lead screw 54 and operates to rotate lead screw 54 in the direction of double arrow C.

The hand knob 58 is preferably made of an elastic material and is pressed on to the end of the lead screw 54 such that when excessive torque is applied to the hand knob 58 by the user, the hand knob 58 rotates relative to the lead screw 54 in the manner of a slip clutch. This clutching action limits the forces on the internal assembly and the potential for damage that could occur due to over-stressing the components is minimized. The hand knob 58 has a rigid ring 59 affixed thereto and which overlaps a smaller diameter concentric ring 61 (shown in FIG. 3) on the cover 52 for the purpose of preventing entanglement of tubes or wires which may be used in the operating environment.

Accordingly, the overall operation of the tilt mechanism may now be described. To change the tilt angle of the infant bed 16, the operator merely grasps and rotates the hand knob 58 in one of the directions of arrow C, thereby also rotating lead screw 54. As lead screw 54 is rotated, the threaded engagement with the lead screw slide 46 causes lead screw slide 46 to move laterally along lead screw slide bearing 50, thus causing link 42 to also move laterally along the direction of the double arrow B. That lateral movement of link 42 thus causes rotation of the key 34 in the direction of double arrow D through the offset distance of the lever arm 38.

Thus, the rotational movement of hand knob 58 is translated into lateral movement and then again translated into rotational movement of key 34 at a ninety degree axis of rotation with respect to the axis of rotation of hand knob 58.

Continuing with the operation of the tilt mechanism, therefore, as key 34 rotates, its connection with the bent rod 28 thereby causes rotation of the bent rod 28 along its axis of rotation. Since the bent rod 28 is fitted within the elongated slots 26 of bed lifter 20, the bed lifter 20 rotates and thus raises and/or lowers the infant bed 16 depending, of course, on the direction of rotation of the hand knob 58.

Due to the various mechanisms through which the rotation of hand knob 58 translates that movement ultimately to the infant bed 16, and particularly due to the provision of lead screw 54, when the operator stops rotating hand knob 58, the infant bed 16 will remain in that selected position. Thus the operator may move the infant bed 16 to any desired position within ultimate limits, and the bed is infinitely adjustable within those limits and will maintain the position selected without any further locking means.

Thus, the tilt mechanism allows the use of a large hand knob 58 for convenience the operator for ease in gripping and manipulating the hand knob 58 yet that hand knob 58 is located at the side of the incubator 10 and is therefore in a position that does not interfere with the operation of a front door or impede access to the infant. In addition, the majority of the components are located outside the infant compartment and thus free from contamination.

As a further facet of the present invention, the tilt mechanism is designed so as to be readily disassembled and assembled so that personnel may clean the components.

Figure 3:
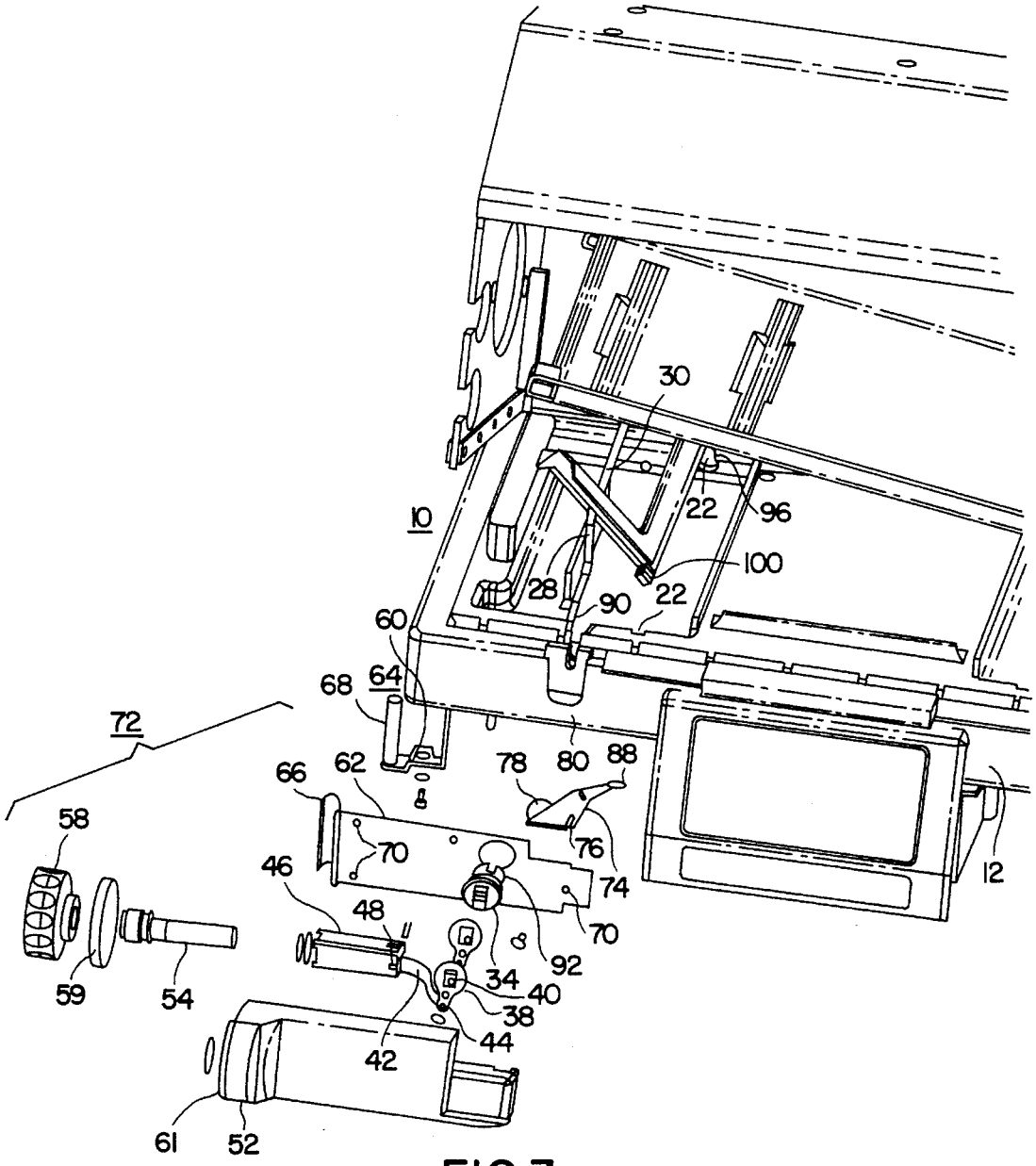
FIG. 3 is an exploded, isometric view illustrating additional details of the construction of the tilt mechanism of the present invention.
Figure 4:
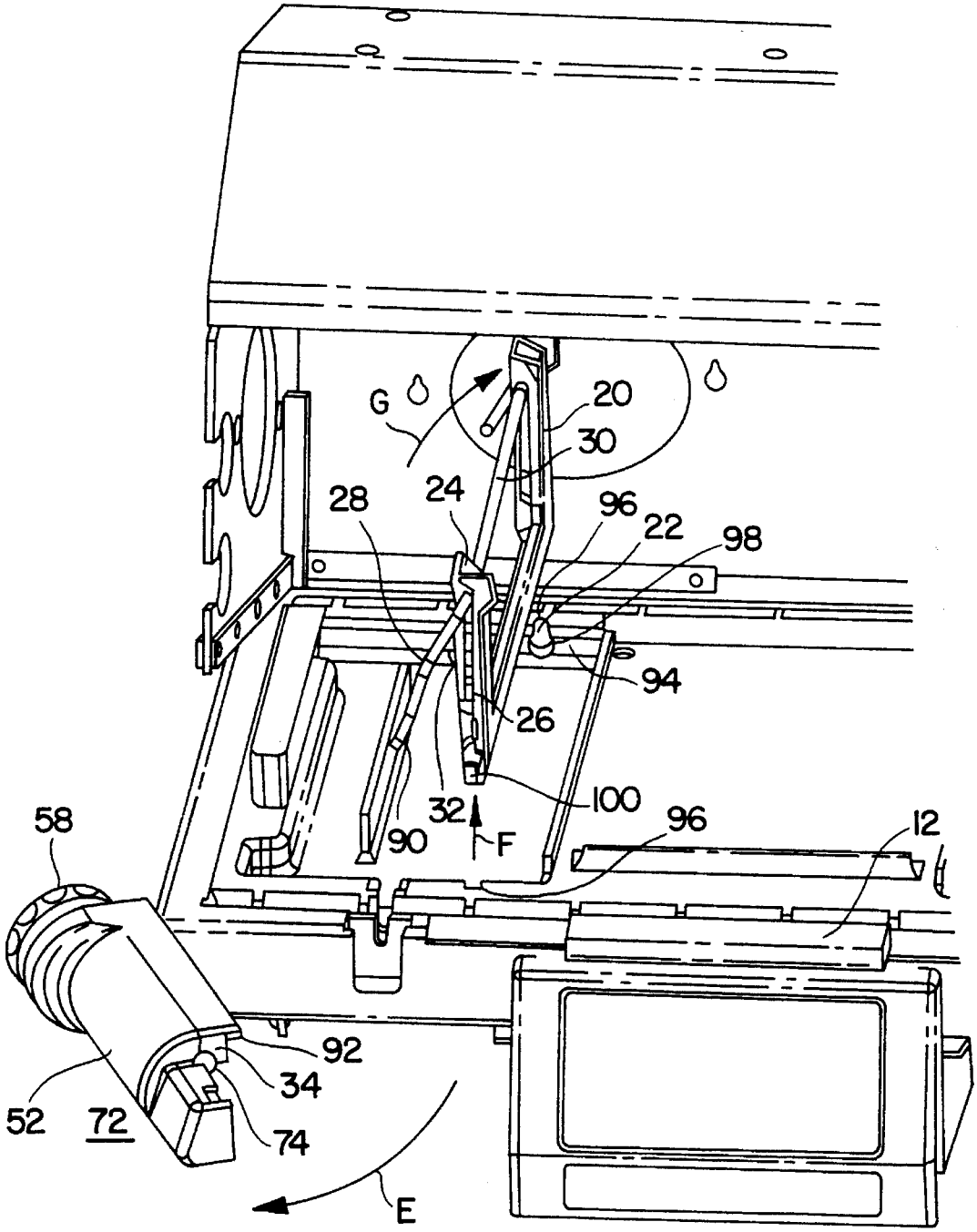
FIG. 4 is an exploded, isometric view illustrating further details of the present construction.

Taking, therefore, FIGS. 3 and 4, there is shown exploded views of the tilt mechanism of the present invention and showing some of the features that allow such disassembly and assembly to be accomplished.

As shown in FIG. 3, the tilt mechanism is basically mounted to the base 12 of incubator 10 by means of a mounting bracket 60 which is affixed to the side of the incubator 10 by conventional means, not shown. The mounting bracket 60 interfits with a bracket plate 62 by means of a hinge 64. As shown, the hinge 64 comprises a curved tab 66 extending from the bracket plate 62 that partially encircles a pin 68 on the mounting bracket 60 such that the two components are hinged together, however, various types of hinge arrangements may be used to create a hinge mechanism between the mounting bracket 60 and the bracket plate 62, it being sufficient that the bracket plate 62 be capable of swinging outwardly from the base 12 of the incubator 10 as shown by the arrow E of FIG. 4.

Bracket plate 62 is secured to the cover 52 by conventional means such as screws, not shown passing through holes 70 so that the cover 52 and the bracket plate 62 basically comprise a compact tilt mechanism assembly 72 that swings away from the incubator 10 and which contains those parts of the tilt mechanism commencing with the key 34 through the hand knob 58.

The tilt mechanism assembly 72 is prevented from swinging outwardly when in operation by means of a latch 74 that is pivotally mounted to bracket plate 62 by a pin 76. That latch 74 interacts with the base 12 of incubator 10 by means of latch surface 78 latching under outer wall 80 formed in the base 12. The outer wall 80 includes a inner surface which mates with the latch surface 78 when the latch 74 is pivoted into its operating position. As can be seen, returning briefly to FIG. 1 or 2, when the tilt mechanism assembly 72 is positioned in its operative position, the latch 74 secures the tilt mechanism assembly 72 to the incubator 10.

The latch 74 may also have a tab 88 for ease of the user in unlatching the latch 74 for disengagement of the tilt mechanism assembly 72.

Further features allowing the easy removal of the components of the present tilt mechanism include the means of connecting between the external end 90 of the bent rod 28 which is formed at an angle, generally a 90 degree angle and which is sized so as to fit within a groove 92 formed in the internal face of the key 34. By this means, the bent rod 28 and the key 34 are locked together for rotational movement when the tilt mechanism assembly 72 is in its operative position, yet the two components part readily when the latch 74 is pivoted upwardly and the tilt mechanism assembly 72 is pivoted outwardly as shown in FIG. 4.

In FIG. 4, in particular, the details of the pivot point 22 for the bed lifter 20 is also shown and which also contributes to the disassembly and assembly of the tilt mechanism. The pivot point 22 is formed in a flange 94 in the base 12 and features a rectangular entrance opening 96 and a circular opening 98 that receives and retains the generally rectangular end 100 along the axis of rotation of the bed lifter 20. By this interfitting, the bed lifter 20 may be assembled or disassembled to the base 12 by being inserted while in a vertical position as shown by arrow F in FIG. 4. In the vertical position, the rectangular ends 100 of the bed lifter 20 can be fitted into the circular opening 98 within flange 94 since the rectangular ends 100 will fit through the rectangular entrance openings 96.

Once the rectangular ends 100 are within the circular openings 98, however, they are locked within the circular openings as soon as the bed lifter 20 is rotated to a position away from the vertical position. Accordingly, while the bed lifter 20 is freely rotatable with respect to the base 12, it can only be removed or replaced when it is in the vertical position of FIG. 4.

Taking, therefore the disassembly procedures, latch 74 is lifted by the operator which disengages the tilt mechanism assembly 72 from the base 12. The operator can then swing the tilt mechanism assembly 72 outwardly as shown by the arrow E of FIG. 4. This allows the bent rod 28 to be lifted out of the base 12 which, in turn, allows the bed lifter 20 to be rotated to the vertical position as shown by the arrow G of FIG. 4. At this point, the bed lifter 20 and the bent rod 28 may be lifted free of the base 12 and removed from the incubator 10. Thus, the operator has easy access to all of the parts of the tilt mechanism for cleaning.

The reassembly, of course, is easily accomplished by merely reversing the aforedescribed procedures for disassembly. Thus, the tilt mechanism is easily disassembled for cleaning and is again easily reassembled.

While the present invention has been set forth in terms of a specific embodiment, it will be understood that the tilt mechanism herein disclosed may be modified or altered by those skilled in the art to other configurations. Accordingly, the invention is to be broadly construed and limited only by the scope and spirit of the claims appended hereto.

We claim:

1. An infant incubator having an infant bed contained therein adapted to underlie an infant, said infant incubator having a tilt mechanism for adjusting the angular position of said infant bed, said tilt mechanism comprising:

at least one bent rod contained within said infant incubator and having one free end thereof, said at least one bent rod rotatably mounted to said infant incubator along an axis of rotation and having an offset portion located beneath the infant bed, said offset portion adapted to move said bed upwardly or downwardly as said one free end thereof is rotated about said axis of rotation, a lead screw affixed to said incubator exterior to said incubator and being rotatable along a fixed axis of rotation with respect to the incubator, linkage means connected to said lead screw and said one free end of said bent rod, said linkage means adapted to translate the rotation of said lead screw to cause corresponding rotation of said one free end of said bent rod to thereby raise or lower said infant bed to a desired position and to retain said infant bed in said desired position.

2. An infant incubator as defined in claim 1 wherein said axis of rotation of said at least one bent rod and said lead screw are positioned at an angle with respect to each other.

3. An infant incubator as defined in claim 2 wherein said angle is approximately 90 degrees.

4. An infant incubator as defined in claim 1 wherein said one free end of said at least one bent rod extends to the exterior of the incubator.

5. An infant incubator as defined in claim 4 wherein said linkage means is located exterior of said incubator and is readily removable therefrom.

6. An infant incubator having an infant bed contained therein adapted to underlie an infant, said infant incubator having a tilt mechanism for adjusting the angular position of said infant bed, said tilt mechanism comprising:

at least one bent rod rotatably mounted within said infant incubator and having one end thereof extending to the exterior of said incubator, said at least one bent rod rotatably mounted to said infant incubator along an axis of rotation and having an offset portion located beneath said infant bed, said offset portion adapted to move said infant bed upwardly and downwardly as said one end thereof is rotated about said axis of rotation, means external of said incubator to rotate said at least one bent rod, said means comprising a pivot affixed to said external end of said bent rod and having a point offset with respect to said axis of rotation of said rotatable bent rod, a linkage having one end thereof affixed to said pivot at said offset point and having the other end threaded, said threaded end being constrained from rotational movement, a lead screw threadedly engaged to said threaded end of said linkage and being rotatably mounted to the exterior of said incubator, said lead screw being rotatable by a user to move said linkage laterally to thereby rotate said at least one bent rod to raise and lower said infant bed to a desired position and to retain said infant bed in said desired position.

7. An infant incubator as defined in claim 6 wherein said external end of said bent rod extends to the exterior of the incubator.

8. An infant incubator as defined in claim 6 wherein said lead screw has an axis of rotation that is at an angle with respect to the axis of rotation of said rotatable bent rod.

9. An infant incubator as defined in claim 8 wherein said angle is about 90 degrees.

10. An infant incubator as defined in claim 6 wherein said lead screw includes a knob rotatable by the user and wherein said knob is frictionally engaged to said lead screw and rotates with respect to said lead screw when excess torque is applied by the user.

11. An infant incubator having an infant bed contained therein adapted to underlie and infant, said infant incubator having a tilt mechanism for adjusting the angular position of said infant bed, said tilt mechanism comprising:

at least one bent rod mounted within the infant incubator and rotatable within the incubator about an axis of rotation, said at least one bent rod having an offset portion located beneath the infant bed and adapted to move the infant bed upwardly or downwardly as said bent rod is rotated about its axis of rotation, said at least one bent rod having one end thereof extending outwardly, an actuating mechanism coupled to said one end of said at least one bent rod for rotating said one end, a housing containing said actuating mechanism, said housing being pivotally affixed to the exterior of the incubator and being movable with respect to the incubator, said actuating mechanism being contained within said housing and is uncoupled from said at least one bent rod when said housing is pivoted away from said incubator for removal of said actuating means.

12. An infant incubator as defined in claim 11 wherein said housing further includes a latch for securing and unsecuring said housing to the incubator.

13. An infant incubator having an infant bed contained therein adapted to underlie an infant, said infant incubator having a tilt mechanism for adjusting the angular position of said infant bed, said tilt mechanism comprising:

at least one bed lifter positioned beneath said infant bed and rotatably secured to the interior of said incubator, said at least one bed lifter adapted to raise or lower said infant bed as said at least one bed lifter is rotated, at least one bent rod positioned beneath said infant bed and rotatably secured to the interior of said incubator, said at least one bent rod having a free end and having an offset portion, said offset portion engaging said at least one bed lifter and to rotate said at least one bed lifter as said at least one bent rod is rotated, a lead screw affixed to the exterior of said incubator and being rotatable along a fixed axis of rotation with respect to said incubator, linkage means affixed to said incubator and adapted to translate the rotation of said lead screw to cause corresponding rotation of said one free end of said bent rod to thereby rotate said at least one bed lifter to raise or lower said infant bed to a desired position.

14. An infant incubator as defined in claim 13 wherein said at least one bed lifter includes a plurality of elongated slots and said offset portion of said at least one bent rod extends through said slots.

15. An infant incubator as defined in claim 13 wherein said free end of said at least one bent rod extends to the exterior of the incubator.

16. An infant incubator as defined in claim 13 wherein a large knob is affixed to the lead screw and is readily rotatable by an operator to rotate said lead screw, said large knob being positioned adjacent the side of the incubator.

17. An infant incubator as defined in claim 16 wherein an overlapping ring is interposed intermediate said large knob and said side of said incubator to prevent entanglement of wires or tubes between the large knob and the side of said incubator.

* * * * *